US006273767B1

(12) United States Patent
Mustonen

(10) Patent No.: US 6,273,767 B1
(45) Date of Patent: Aug. 14, 2001

(54) MACHINE FOR PERFORMING WORK ON LAND AND/OR IN WATER

(75) Inventor: Antero Mustonen, Kuopio (FI)

(73) Assignee: Force Pair Oy, Kuopio (FI)

( * ) Notice: Subject to any disclaimer, the term of this patent is extended or adjusted under 35 U.S.C. 154(b) by 0 days.

(21) Appl. No.: 09/663,704

(22) Filed: Sep. 18, 2000

Related U.S. Application Data

(63) Continuation of application No. PCT/FI99/00210, filed on Mar. 18, 1999.

(30) Foreign Application Priority Data

Mar. 18, 1998 (FI) ..... 980135

(51) Int. Cl.[7] ..... B63H 19/08
(52) U.S. Cl. ..... 440/12.51
(58) Field of Search ..... 440/12.5, 12.51, 440/12.52, 12.53, 12.54, 12.55–12.61

(56) References Cited

U.S. PATENT DOCUMENTS 3,486,253 * 12/1969 Bruggeman ..... 37/345
4,124,124 * 11/1978 Rivet ..... 440/12.56
4,592,155 * 6/1986 Mustonen ..... 37/345
5,141,384 8/1992 Hvolka .

FOREIGN PATENT DOCUMENTS 1 781 256 12/1970 (DE) .
0 325 091 7/1989 (EP) .
2 148 204 5/1985 (GB) .
457 970 2/1989 (SE) .

* cited by examiner

*Primary Examiner*—Jesus D. Sotelo
(74) *Attorney, Agent, or Firm*—Pillsbury Winthrop LLP

(57) ABSTRACT

The invention relates to a machine for performing work on land and/or in water, which comprises an underframe which moves on wheels or corresponding mechanism, a platform body on top of the underframe, and extension arm attached to the underframe which rotates in relation to the underframe and platform body and a work implement attached to the extension arm. A machine according to the invention has an extension arm which is a telescopic extension arm, to the end of which detachable work implements may be attached, a platfrom body which is attached to the underframe and can move along the longitude of the underframe, and a front edge on the platform body which is essentially open to enable loading and unloading.

9 Claims, 6 Drawing Sheets

MACHINE FOR PERFORMING WORK ON LAND AND/OR IN WATER

Figure 1:
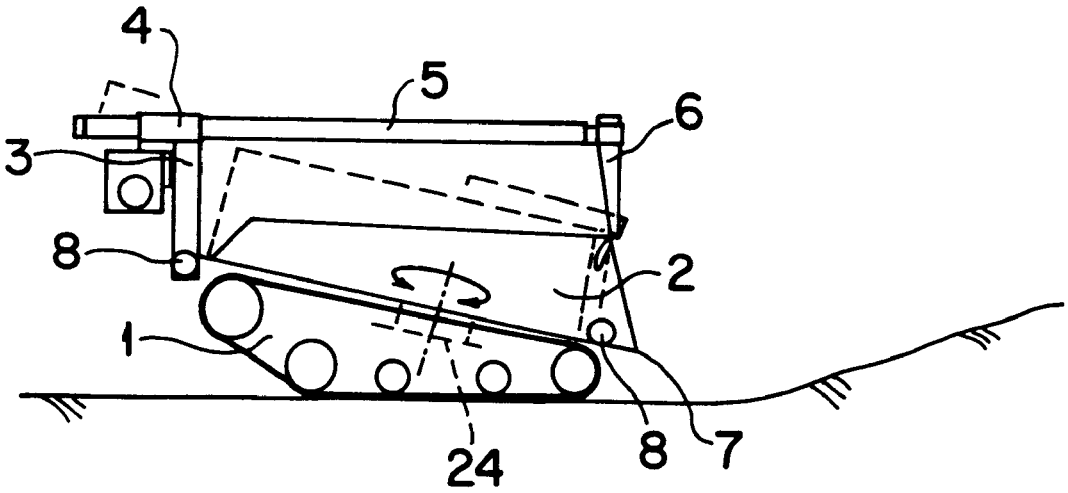

This is a Continuation International Appln. No. PCT/FI199/00210 filed Mar. 18, 1999.

The invention relates to a machine for performing work on land and/or in water, which comprises an underframe which moves on wheels or corresponding mechanism, a platform body on top of the underframe, an extension arm attached to the underframe which turns in relation to the underframe and platform body and a working implement attached to the extension arm.

There are many different apparatuses and machines which have extension arms, or the like, with a shovel, forklift fork, lifting platform or other implement. These implements are connected to conventional land machines moving on wheels or roller-type underframe, or a corresponding type of machine, and the said implements are used to perform different types of jobs. These machines and implements are generally used for carrying out different on-land work. To do work in water, there are separate machines which are built differently. At present, there are no machines which can do different jobs both on land and in or on water. At present, machines are only intended for one kind of job, but there are machines or apparatuses which are such that the work implement can be altered to do other jobs.

There are many disadvantages involved in moving earth or corresponding masses with the present machines. Presently, machines naturally can only move as much earth or other mass substance as wall fit in/on the machine's shovel, forklift fork or corresponding hoisting implement, which is, in general, a relatively small amount. The method used in filling and emptying the shovel on conventional machines is based on the process of the shovel, or corresponding implement, being pushed under or into the mass. Thus, the weight of the machine is used and the power used to load the mass is transferred to the ground via the machine wheels or corresponding base. Use of these machines presupposes that the ground is such that it will provide enough friction to prevent the machine from rolling. The machines are used to raise ground substance or other mass from the ground and then transfer it to the desired location. During the transfer, the ground substance, or other mass, is in the shovel or corresponding implement, which is, in some phase of the transfer, at least partially outside of the machine. If the machine's center of gravity or of the load is such that the machine is not stable, problems may arise in the event of an overload.

The present invention seeks to provide a machine in which the aforementioned disadvantages have been eliminated. In particular, the invention seeks to provide a machine which is suitable for use in different types of jobs on land and/or in water and is easy to adapt to different work purposes. Further, the invention seeks to provide a machine with an advantageous structure, in that It is simple and easy to use. A specific intention is to provide a machine which is safe to use.

The object of the invention is accomplished by means of a machine, the characteristics of which are set forth in the claims.

A machine in accordance with the invention has a telescopic extension arm, to the end of which is attached a detachable work implement. Additionally, the platform body is connected to the underframe in such a way that the platform body can move longitudinally along the length of the underframe, and the front edge of the platform body is essentially open for loading or unloading. This kind of platform body turns in relation to the underframe in the desired way, for example, so that its front edge touches the ground or other base and the platform body is in an angled position. Using the telescopic extension arm, the work implement can be moved to the desired place in relation to the underframe and the platform body. Since the work implement is detachable, it is easy to change it and replace it with another work implement.

In one advantageous embodiment of the invention, the platform body is pivotally connected to the underframe and advantageously rotates in relation to the pivotal center. Thus, the platform body can easily and simply be shifted In the desired direction without having to turn the underframe.

In one additional advantageous embodiment of the invention, the machine comprises an attached extension arm, an essentially plate-like grabbing plate to move the mass from the excavation area to the platform body and then out of the platform body. With this kind of grabbing plate, moving mass, which can be either ground mass or other mass, is done effectively, quickly and safely. When using the machine to move mass, the platform body is shifted so that it is angled downwards and resting against the ground. In this downward slanting position it is easy to load the platform body and correspondingly to unload it. The transfer of the mass is based on couple force. The force is applied by the grabbing plate to moving the mass. In the loading process, the grabbing plate is carried a distance from the end of the platform body, then pushed into the mass and drawn back toads the platform body, whereupon the grabbing plate either moves the mass to the platform body and/or the pulling force of the grabbing plate simultaneously causes the edge of the platform body to be immersed into the mass. In practice, the grabbing plate and the platform body move simultaneously, thus forming a couple force which does the work without the underframe having to move while the platform is being loaded. Thus, using the machine, mass can be loaded without the need to direct force towards the ground in order to move the mass. The ground only bears the weight of the machine and the mass. The machine can be used on ground where conventional machines are not able to load mass. Mass substances or individual objects, for example, from water or ice, can be loaded onto the machine.

When the platform body is full, it can be shifted on the underframe of the machine. Thus, the mass and the platform body remain in close proximity to the underframe and wheels so the machine is especially stable and transport is easy and simple. The mass can even be conveyed forward while the machine is moving, if the mass is relatively solid. If the mass is easily agitated, it is advantageous to use the grabbing plate in the front part of the platform body as a cover to prevent the run-off of mass.

The machine can of course be used in the usual way to do work and move on wheels or rollers, in which case the blade of the front edge of the platform body can perform clearing or other jobs or, correspondingly, mass or corresponding substance can be handled with the grabbing plate or corresponding implement.

In another advantageous embodiment of the invention, the machine comprises a vessel which moves on water, and inside of which there is space to fit the underframe of the machine, and in said space support components for the machine have been installed, while the corresponding support components have been attached to the underframe in order to detachably connected the underframe and platform body to the vessel. With this kind of a vessel, a machine in accordance with the invention can be transferred to water using the vessel, the machine can perform jobs in and on the water. Thus, the machine can accomplish different kinds of jobs in the water which correspond to the jobs it can perform on land. Additionally, the machine can be moved in the desired way from one place to another.

In another advantageous embodiment of the invention, the machine comprises moving devices which are attached to the vessel and are used to move the support components vertically in the vessel. Using the moving devices, the underframe and all machinery attached to it can be moved vertically and horizontally in different ways, whereupon the machine can effectively work in water, for example, to dredge mass, in this case, with moving devices attached to the vessel, the underframe of the machine is at an incline so the platform body can push forward and transfer mass into the platform body from the water bottom.

In the following embodiment of the invention, the support components comprise runners which run horizontally along both inner walls of the vessel. With the runners, the underframe of the machine and the platform body can easily be run inside the vessel and can easily be attached to the vessel in a way most appropriate for the purpose.

In the following embodiment of the invention, the machine comprises an underframe with a cranking device with a cable. With this cranking device the uses of a machine according to the invention become manifold. The cranking device and cable make it possible for the telescopic extension arm to function in many ways, for example, as a hoisting device, by attaching a hoist to the end of the extension arm. In this case, in between an extension arm and underframe according to the invention, there is a detachable support device which enables the extension arm to support the weight.

In a certain advantageous embodiment of the invention, there is a detachable pile-driving implement attached to the end of the telescopic extension arm to drive piles into the ground or into some other base substance. In this case, piles can be driven with the machine for varying purposes, both on land and in water.

Figure 2:
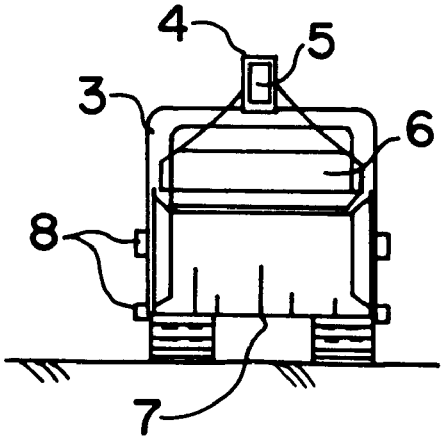
Figure 3:
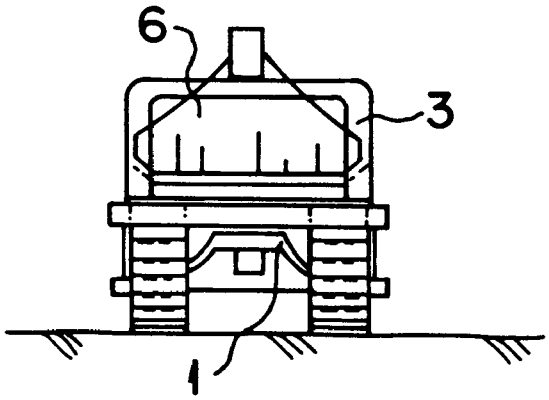
Figure 4:
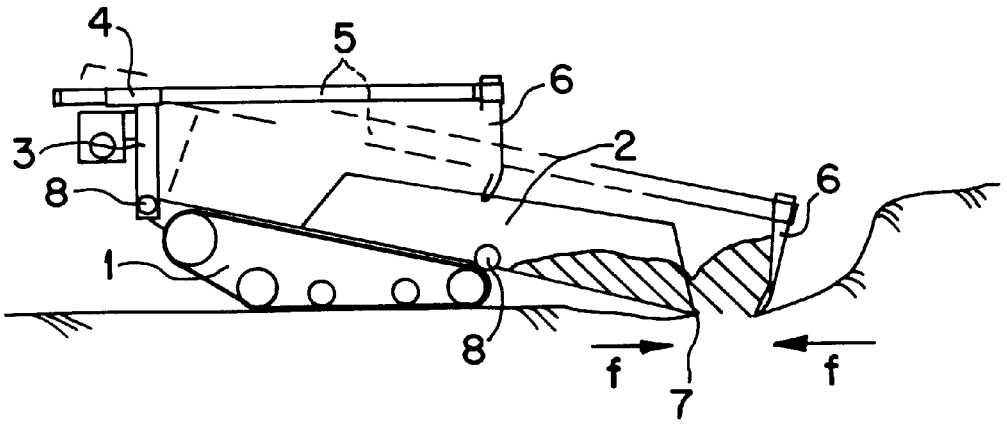
Figure 5:
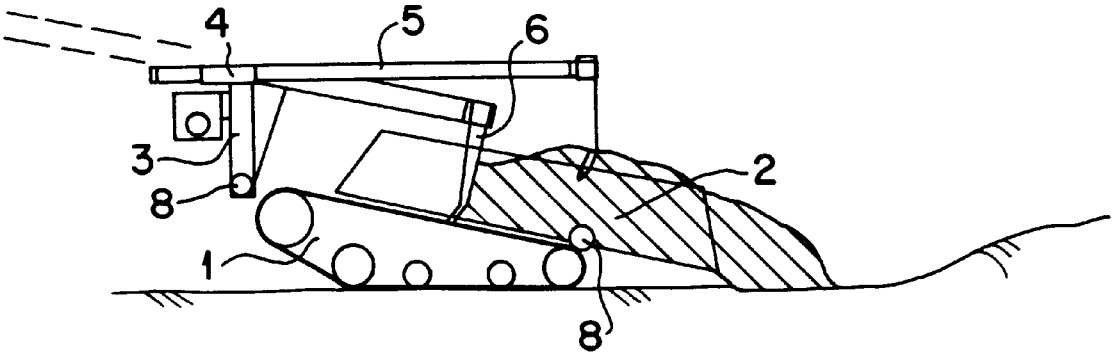
Figure 6:
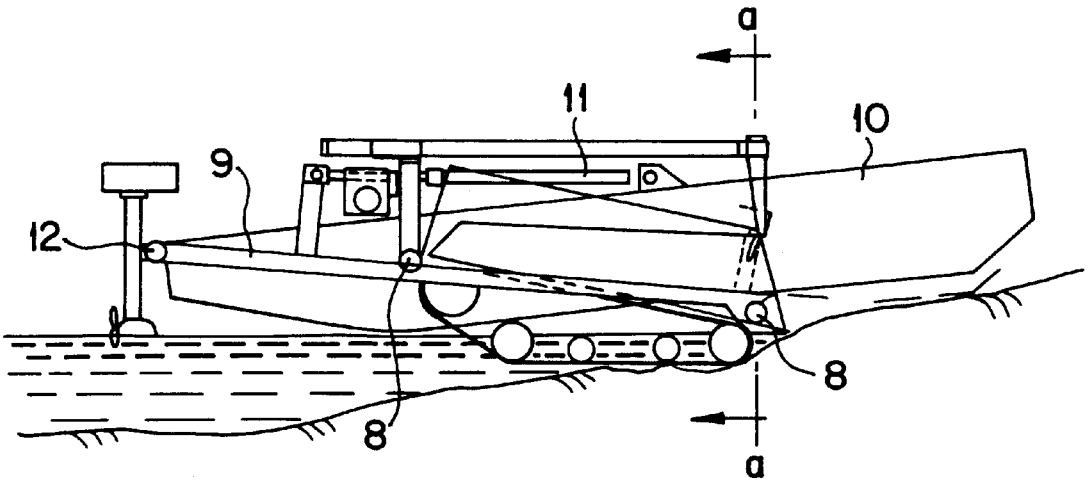
Figure 7:
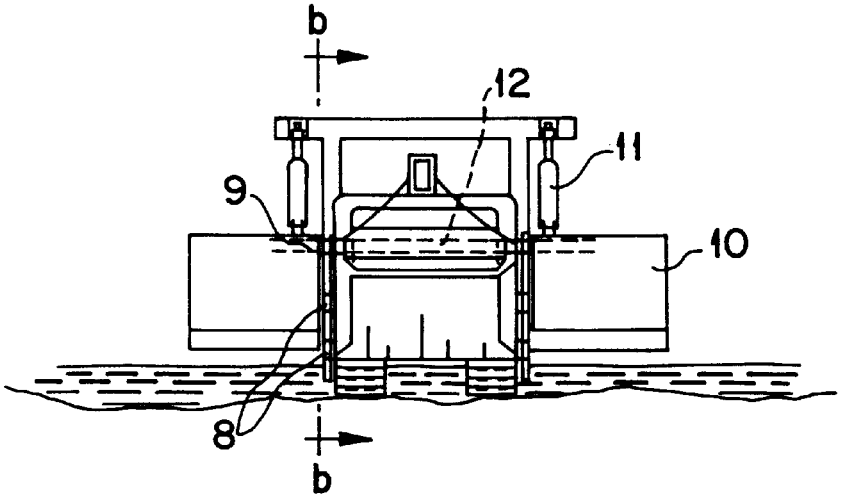
Figure 8:
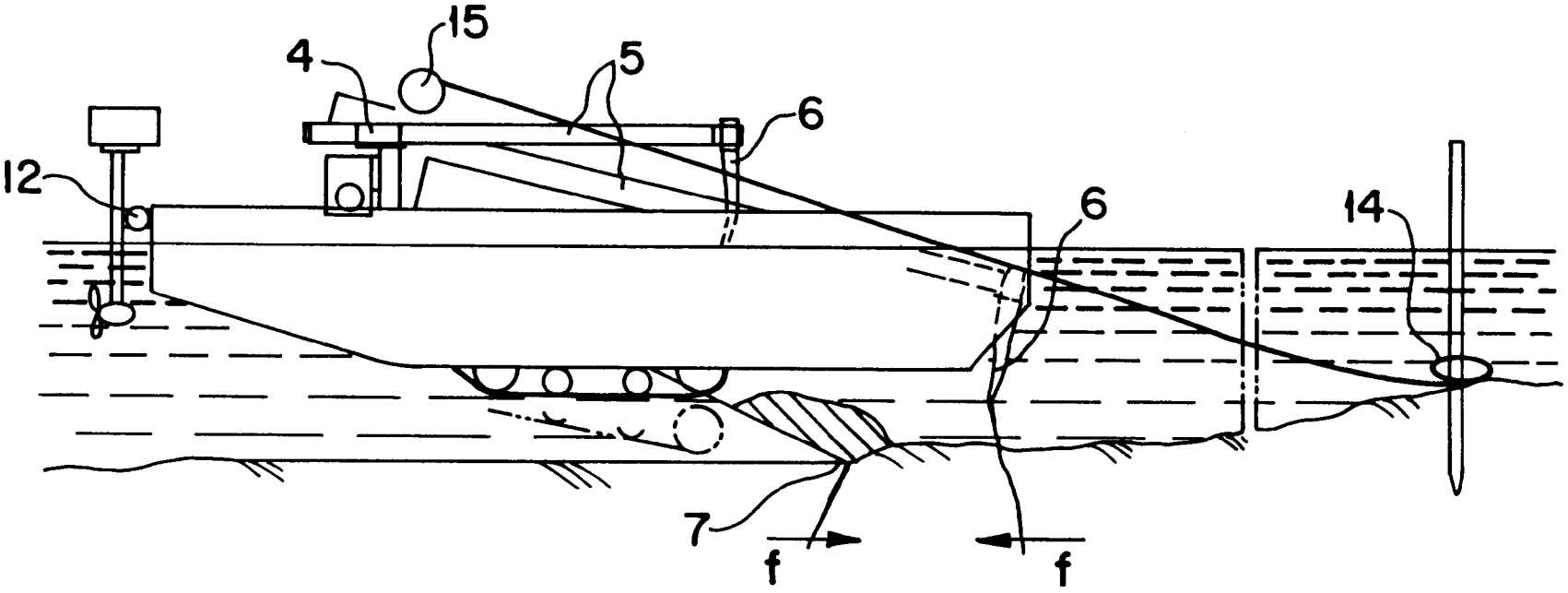
Figure 9:
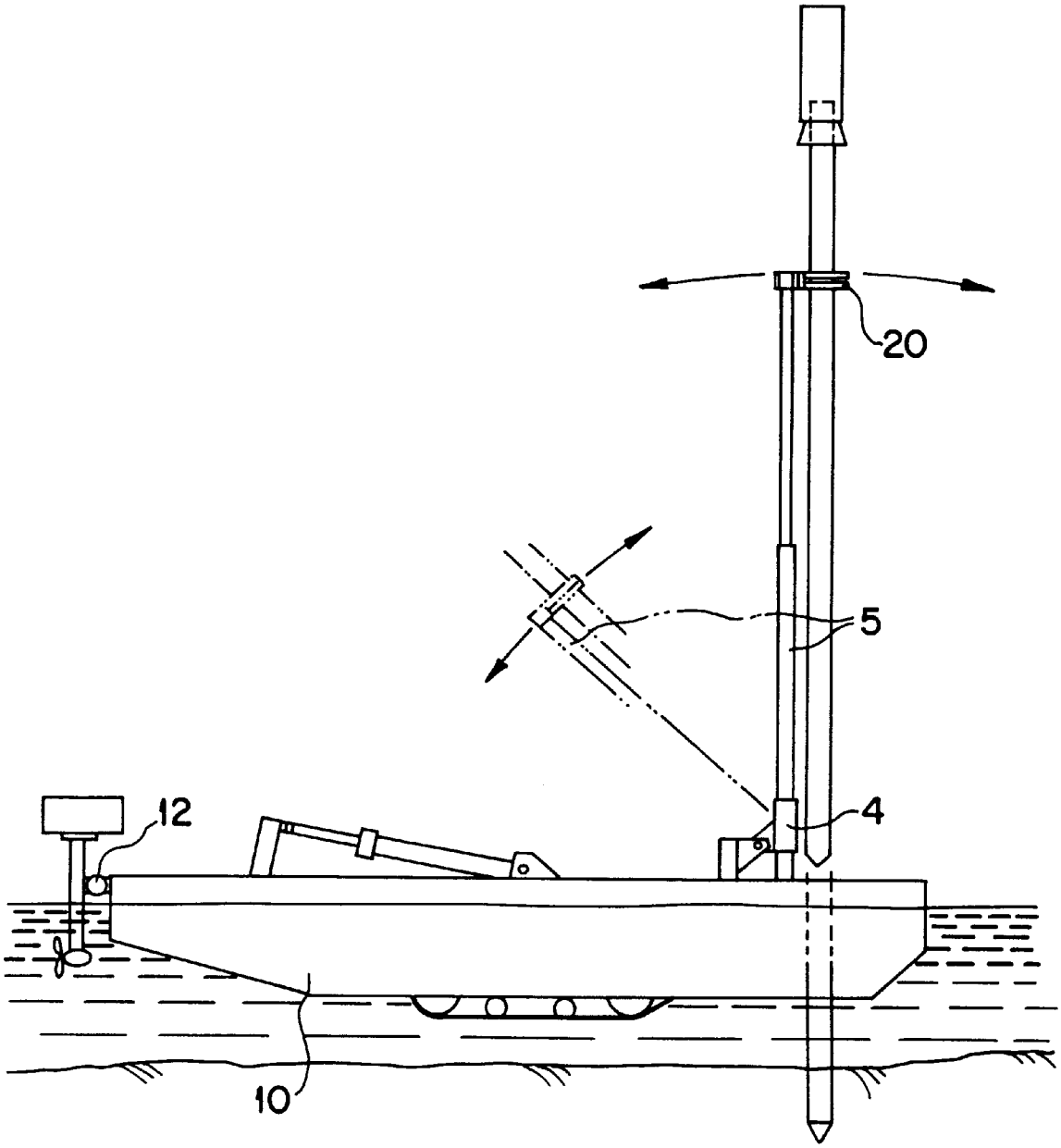
Figure 10:
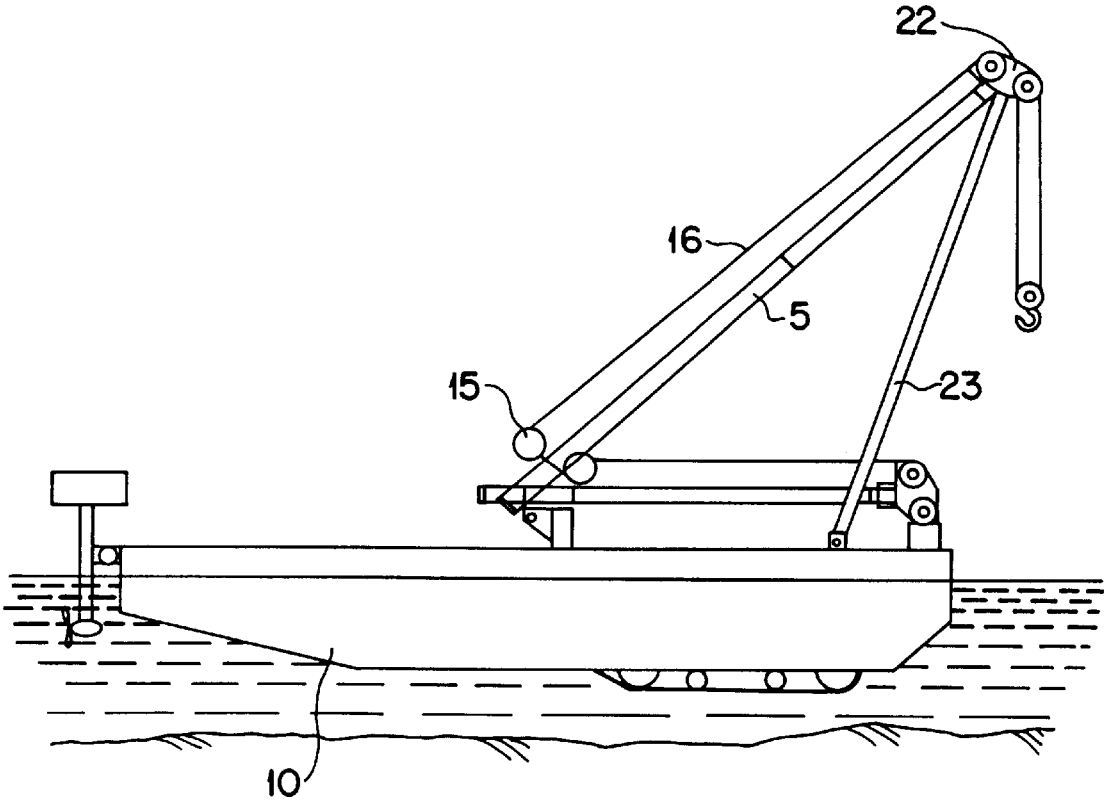

Next, the invention will be described in more detail with reference to the accompanying drawings in which:

FIG. 1 diagrammatically illustrates one machine according to the invention, as seen from the side, FIG. 2 illustrates a machine according to FIG. 1, as seen from the front, FIG. 3 illustrates a machine according to FIG. 1, as seen from the back, FIG. 4 illustrates a machine according to FIG. 1 as the platform body is being filled, as viewed from the side, FIG. 5 illustrates a machine according to FIG. 1 as the load is being emptied, as viewed from the side, FIG. 6 illustrates a machine according to FIG. 1 as it is moving into the vessel, as viewed from the side, and simultaneously illustrates a machine according to FIG. 7, as viewed from angle b—b, FIG. 7 illustrates a machine according to FIG. 6, as viewed from angle a—a, FIG. 8 illustrates a machine according to FIG. 6 as it is dredging the water bottom, FIG. 9 illustrates a second way to work with the vessel, and, FIG. 10 illustrates a third way to work with the vessel.

A machine like the one illustrated in the figures has a standard runner frame structure, which forms the underframe 1, as its supporting structure. On top of the underframe 1 is the platform body 2 which moves lengthwise along the longitude of the underframe and by which a longitudinal motion in a downward slanting direction can be attained with separate mechanisms. Neither these mechanisms nor the machinery attached to the underframe are described here in any detail, but they are, as such, conventional machines. It is advantageous to make the platform body, at least the front part of the machine & and the bottom, out of a durable material, such as steel. The supporting structure 3 is attached by joints to the back part of the frame of the underframe. At the upper end of the supporting structure 3 is the controlling piece 4, where the telescopic arm 5 is located. This being the case, the extension arm is pivotally connected to the underframe. Different work implements are to be attached to the end of the extension arm. In many of the figures, the extension arm is shown in two different positions to illustrate work.

The tipping center 24 is designed to the underframe 1, and the platform body 2 is pivotally connected to the tipping center 24. These turning devices are not shown in the figures, but are, as such, conventional devices appropriate for the purpose.

In embodiments according to FIGS. 1–8, the work implement is a grabbing plate, or excavating plate 6, which is attached to the end of the telescopic extension arm.

In these figures, movement of the extension arm and the platform body are produced by a hydraulic cylinder, which is not pictured. Other methods may be used in other embodiments. Hydraulic or other power sources or accessory components are not described in detail because they are conventional, technology which is suited to the purpose in question.

FIGS. 4 and 5 illustrate the machine being used to move mass on land. By the method illustrated in the figures, in the loading phase, the front part of platform body 7 is pushed down to the ground and the telescopic extension arm 5 is extended a distance from the end and driven into the mass. The mass is moved onto the platform body 2 with the grabbing plate 6 attached to the end of the telescopic extension arm by pulling the arm towards the platform body. On the basis of FIG. 4, it can clearly be seen that no pushing force from the runners is needed in the loading phase, rather the grabbing plate moves the mass from the open front part of the platform body, or most often, as the front edge simultaneously forces the mass onto the platform. In this case, a force couple is formed, so that the machine may move a little in relation to the mass, but actual wheel movement is not necessary. The platform body can be filled as the telescopic extension arm repeatedly draws mass into it, and when the platform body is full, it is moved back to the transport position on the underframe. The grabbing plate and telescopic arm are measured so that the grabbing plate functions as an end for the open-ended platform when the machine is in motion.

In FIG. 5, the platform body is shown being emptied, which can occur with the grabbing plate by moving it with the extension arm and pushing the mass off of the platform. It is also possible to empty the mass from the platform body by tilting it in relation to the underframe with the use of different mechanisms.

FIGS. 6 and 7 illustrate a vessel which is part of the machine and is comprised of pontoon walls 10 and the space between the pontoon walls. There are runners 9 which are located on both of the inside pontoon walls 10, and the support components 8 are located in the underframe. The support components 8 are advantageously placed at the front and back edge of the underframe, but the placing and number of support components can vary for different embodiments. The support components 8, being part of the underframe, are placed on the runners 9 and the support components, being supported and guided on the runners, are moved, along with the platform body, within the space of the pontoon walls and are dimensioned to fit in the space. Support structures and hydraulic cylinders 11 are connected to the pontoon walls so that the incline of the runners can be altered in the desired way in relation to the pontoon walls. In the back of the vessel, between the pontoon walls, a connecting pipe 12 functions as a support joint for the support components.

In an embodiment according to FIG. 8, mass is being dredged from the water using the machine. This figure illustrates the cranking device 15 and the cable 16 which are part of the machine and which are also connected to the anchor 14, which is a pole in this particular embodiment. When in use, the machine's runners move inside the pontoon walls in such a way that the underframe and the platform body of the machine are at an angle to the pontoon walls and the front edge on the platform body is at the desired dredging depth. The machine is moved using the crank, cable and anchor, whereupon the mass on the bottom is transferred onto the platform body. The cable and crank form a so-called secondary force which is used, for example, in raking or leveling the bottom. When the amount of mass and need for Increased force grows, the grabbing plate can also be used. The telescopic arm and the plate connected to it are used to transfer mass onto the platform body in the manner shown in the figure and also in a manner which does not use the crank or anchor pole.

The embodiment illustrated in FIG. 9 shows, on the end of the telescopic extension arm, a gripping device 20, by which the pile-driving implement 21 is attached to the underframe. The figure shows the driving implement in two different positions. With the machine, pile-driving can be carried out both on land and in the water.

In the embodiment illustrated in FIG. 10, idle gears 22 are placed at the end of a telescopic boom or extension arm as a support device and the cable 16 on the cranking device 15 is lead through the gears and is equipped with a crane hook. Additionally, in between the end of the boom or extension arm and the vessel or underframe, there is a supporting arm 23 for support. In this case, the machine can be used for lifting different loads or machinery in water or on land.

The invention is not limited to the advantageous embodiments set forth in the above. The invention is versatile and its form can vary within the frame of the idea of the invention put forth in the claims.

What is claimed is:

1. A machine for performing work on at least one of land and water which comprises:

an underframe which moves on at least one of wheels and a corresponding mechanism, a platform body on top of the underframe, and an extension arm attached to the underframe which turns in relation to the underframe and platform body, and which has a work implement attached to it, wherein the extension arm is a telescopic extension arm to the end of which detachable work implements can be attached, the platform body is connected to the underframe so that it moves longitudinally along the underframe, and the front edge of the platform body is essentially open to enable loading and unloading.

2. A machine as claimed in claim 1, wherein the platform body is attached to the underframe in such a way that it rotates and is advantageously pivotal in relation to a tipping center.

3. A machine as claimed in claim 1 or claim 2, wherein the machine comprises a vessel which moves on water and which has space for the underframe and the platform body, and support components fit inside the space, and corresponding opposite components are attached to the underframe in order to attach the detachable underframe to the vessel.

4. A machine as claimed in claim 3, wherein connected to said vessel is a moving device to move the support components vertically inside the vessel.

5. A machine as claimed in claim 3 wherein the support components are runners which run horizontally along each inside wall of the vessel.

6. A machine as claimed in claim 1, further comprising a grabbing plate which is attached to the extension arm and is used to move mass from an excavation site onto the platform body and to unload the mass from there.

7. A machine as claimed in claim 1, further comprising a cranking device which is connected to the underframe and a cable in the cranking device.

8. A machine as claimed in claim 1, further comprising a detachable gripping device which is attached to the end of a telescopic extension arm and used for attaching a detachable pile-driving implement to the machine in order to drive piles into the ground or water bottom.

9. A machine as claimed in claim 1, further comprising a support device for a hoisting device which is connected to the end of a telescopic extension arm an comprising a detachable supporting arm connected between the extension arm and underframe or vessel and used to support the extension arm.

* * * * *